US009682749B2

(12) United States Patent
Borel

(10) Patent No.: US 9,682,749 B2
(45) Date of Patent: Jun. 20, 2017

(54) TOWING DEVICE WITH A HINGED FAIRLEAD

(71) Applicant: THALES, Neuilly sur Seine (FR)

(72) Inventor: Christophe Borel, Brest (FR)

(73) Assignee: THALES, Courbevoie (FR)

( * ) Notice: Subject to any disclaimer, the term of this patent is extended or adjusted under 35 U.S.C. 154(b) by 184 days.

(21) Appl. No.: 14/357,186

(22) PCT Filed: Nov. 8, 2012

(86) PCT No.: PCT/EP2012/072188
§ 371 (c)(1),
(2) Date: May 8, 2014

(87) PCT Pub. No.: WO2013/068497
PCT Pub. Date: May 16, 2013

(65) Prior Publication Data

US 2014/0326170 A1 Nov. 6, 2014

(30) Foreign Application Priority Data

Nov. 10, 2011 (FR) ..... 11 03427

(51) Int. Cl.
*B63B 21/10* (2006.01)
*B63B 21/66* (2006.01)
*B63B 21/16* (2006.01)

(52) U.S. Cl.
CPC ..... *B63B 21/66* (2013.01); *B63B 21/10* (2013.01); *B63B 21/16* (2013.01)

(58) Field of Classification Search
CPC ..... B63B 21/10; B63B 21/16; B63B 21/66; B66D 1/36; B66D 1/365; B66D 1/38
USPC ..... 114/199, 200, 244, 246, 249, 293; 138/120; 242/157 R, 157.1; 254/393–400, 407, 413–415
See application file for complete search history.

(56) References Cited

U.S. PATENT DOCUMENTS 892,896 A * 7/1908 Rowland ..... A62B 35/04 114/199
2,432,278 A * 12/1947 Bratz ..... F16C 1/10 138/120
3,588,051 A 6/1971 Leeming
4,129,270 A * 12/1978 Robinson ..... B64D 39/00 141/387

(Continued)

FOREIGN PATENT DOCUMENTS

FR 2594406 A1 * 8/1987 ..... B63B 21/22
WO 2010085156 A1 7/2010

*Primary Examiner* — Ajay Vasudeva
(74) *Attorney, Agent, or Firm* — Baker & Hostetler LLP

(57) ABSTRACT

A towing device, intended to be fitted to the deck of a ship, comprises a winch, a cable and a fairlead, the cable running through the fairlead under the action of the winch. The fairlead comprises at least a first and a second sector, the sectors allowing the cable to be guided in a groove made in each of the sectors, a first articulation with a degree of freedom to rotate about an axis, the articulation connecting the two sectors, the axis being substantially perpendicular to a direction in which the cable runs substantially through the fairlead at the articulation, and limiting means that limit the angular travel of the articulation. The sectors and the limiting means are dimensioned so as to prevent the cable from exceeding a lower limit of radius of curvature.

9 Claims, 6 Drawing Sheets

(56) References Cited

U.S. PATENT DOCUMENTS

| | | | | |
|---|---|---|---|---|
| 4,455,961 | A | 6/1984 | Hansen et al. | |
| 6,297,453 | B1 * | 10/2001 | Wigh | H02G 1/10<br>174/74 R |
| 6,433,282 | B1 * | 8/2002 | Traversa | H02G 3/0475<br>138/118 |
| 6,817,595 | B1 * | 11/2004 | Jenkins | B63B 21/10<br>114/200 |
| 7,926,436 | B2 * | 4/2011 | Boatman | B63B 21/18<br>114/200 |

* cited by examiner

TOWING DEVICE WITH A HINGED FAIRLEAD

CROSS-REFERENCE TO RELATED APPLICATIONS

This application is a National Stage of International patent application PCT/EP2012/072188, filed on Nov. 8, 2012, which claims priority to foreign French patent application No. FR 1103427, filed on Nov. 10, 2011, the disclosures of which are incorporated by reference in their entirety.

FIELD OF THE INVENTION

The invention relates to a towing device intended to be fitted to the deck of a ship and allowing the towing of an object trailed behind the ship. The towing device in the conventional way comprises a winch, a cable and a fairlead, the cable running through the fairlead under the action of the winch. This type of device is, for example, used in the field of underwater acoustics, and more particularly for towed active sonars. These sonars generally comprise an emission antenna incorporated into a submersible object or "fish" and a receiving antenna consisting of a linear antenna or "flute". When the sonar is being used as a towed hanging sonar, the fish and the flute are attached to the same cable so that they can be towed by the ship.

BACKGROUND

The cable generally comprises a core made up of electrical and/or optical conductors allowing energy and information to be transmitted between sonar equipment situated onboard the ship and the antennas. The core of the cable is generally covered by strands of metal wires which provide the mechanical strength of the cable. The makeup of the cable dictates a minimum radius of curvature thereof. Below this radius, inadmissible mechanical stresses are induced and cause these elements to deteriorate. The winch fixed to the deck of the ship has a drum onto which the cable can be wound when the sonar is inactive and when the antennas are stowed onboard the ship. The diameter of the drum guarantees that the wound elements will not be curved to a radius smaller than the minimum radius of curvature.

When the towed elements are in the sea, the cable is guided by the fairlead which safeguards its effective radius of curvature. During towing, the ship may alter its speed and its heading. Other involuntary movements of the ship may occur when the sea state worsens, notably in heavy weather. These movements of the ship lead to a change in the direction of the cable with respect to the axis of the ship. In order to prevent changes in direction from damaging the cable, the fairlead may be fixed with respect to the ship and have a flared trumpet shape opening toward the rear of the ship.

Furthermore, in underwater acoustics, the fairlead needs to be suited to allowing the antennas to be raised up onto the deck of the ship. The fairlead is, for example, open at its top. The ship may be equipped with an articulated arm that allows the fish to be passed over the fairlead.

The existing devices are bulky and require an actuator to move the articulated arm. In addition, as the fish is being passed over the fairlead, anti-unrigging systems need to be employed to prevent the cable to which the towed elements are fixed from leaving its housing in the fairlead.

SUMMARY OF THE INVENTION

The invention seeks to alleviate all or some of the abovementioned problems by proposing a towing device that guarantees that the cable cannot bend beyond a minimum radius of curvature and that makes it easier for towed bodies to pass the fairlead. The invention also makes it possible to dispense with an articulated arm intended to take hold of a towed body before it reaches the fairlead as the cable is being wound in.

To this end, the subject of the invention is a towing device intended to be fitted to the deck of a ship and comprising a winch, a cable and a fairlead, the cable running through the fairlead under the action of the winch, characterized in that the fairlead comprises at least a first and a second sector, the sectors allowing the cable to be guided in a groove made in each of the sectors, a first articulation with a degree of freedom to rotate about an axis, the articulation connecting the two sectors, the axis being substantially perpendicular to a direction in which the cable runs substantially through the fairlead at the articulation, and limiting means that limit the angular travel of the articulation, and in that the sectors and the limiting means are dimensioned so as to prevent the cable from exceeding a lower limit of radius of curvature.

BRIEF DESCRIPTION OF THE DRAWINGS

The invention will be better understood and other advantages will become apparent from reading the detailed description of one embodiment given by way of example, which description is illustrated by the attached drawing in which.

For the sake of clarity, in the various figures the same elements bear the same references.

DETAILED DESCRIPTION

The invention is described with reference to the towing of a sonar by a surface vessel. Of course, the invention may be implemented in the case of other towed elements.

Figure 1:
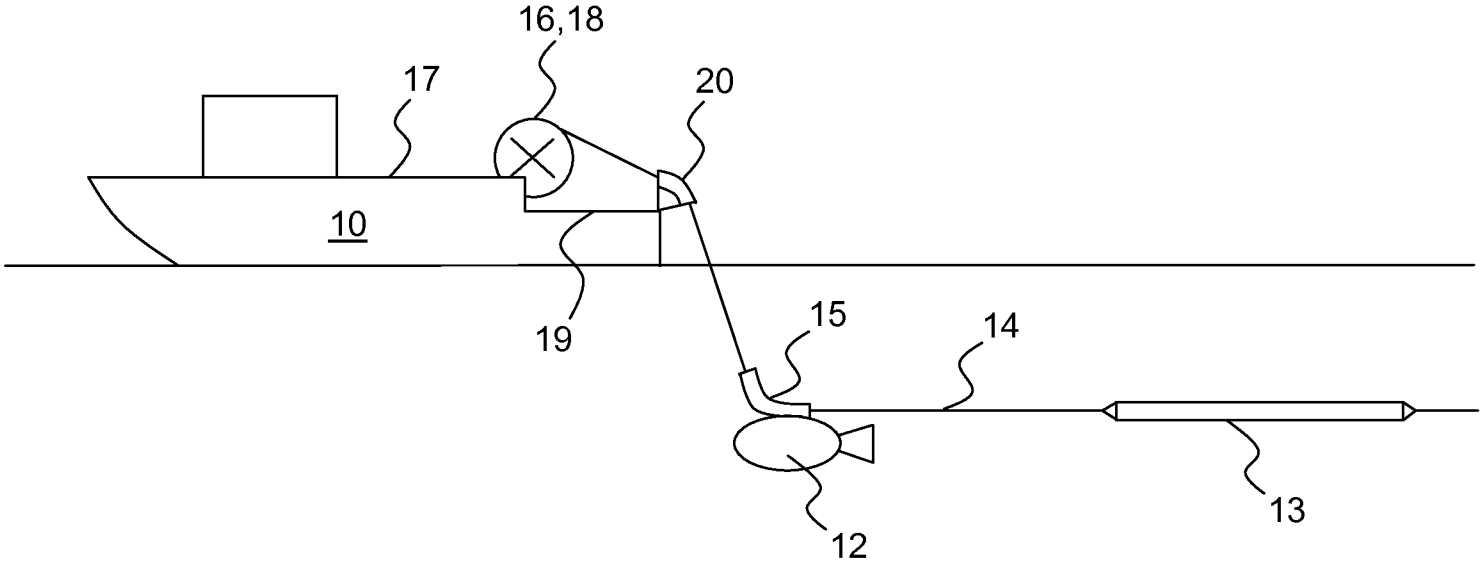
FIG. 1 schematically depicts a ship towing an active sonar.

FIG. 1 depicts a ship 10 towing an active sonar 11 comprising an acoustic emission antenna 12 often referred to as a fish and an acoustic receiving antenna 13 often referred to as a flute. The sonar 11 also comprises a cable 14 that allows the two antennas 12 and 13 to be towed. The cable also carries signals and power between the ship and the antennas 12 and 13 of the sonar 11.

The antennas 12 and 13 are mechanically anchored and electrically and/or optically connected to the cable 14 in a suitable manner. Conventionally, the receiving antenna 13 is formed of a linear antenna of tubular shape identical to those found in passive sonars, hence its name of flute, whereas the emission antenna 12 is incorporated into a voluminous structure of a shape likenable to that of a fish. The receiving flute is generally at the rear, at the end of the cable 14, the fish being positioned on that part of the cable 14 which is nearest to the ship 10. During an underwater acoustic mission, the antenna 12 emits sound waves into the water and the receiving antenna 13 picks up any echoes coming from targets off which the sound waves from the antenna 12 are reflected.

The receiving antenna 13 is generally permanently anchored to the cable 14 whereas the fish 12 for its part is anchored removably. For this purpose, the cable 14 has an anchor zone 15 for the fish 12, in which zone means are installed for mechanically fixing the fish 12 and for electrically and/or optically connecting it to the cable 14.

The launching and retrieval of the antennas 12 and 13 are carried out using a winch 16 arranged on a deck 17 of the ship 10. The winch 16 comprises a drum 18 dimensioned to allow the cable 14 and the receiving antenna 13 to be wound on. The winding of the cable 14 allows the fish 12 to be hauled onboard the ship 10, for example onto an aft platform 19 provided for this purpose.

A fairlead 20 guides the cable 14 downstream of the drum 18. The fairlead 20 constitutes the last element to guide the cable 14 before it drops down into the water. During towing, the inclination of the cable 14 may vary with respect to the longitudinal axis of the ship 10. The variations in inclination are caused notably by changes in the heading and speed of the ship and also in the sea state. One of the functions of the fairlead 20 is to guarantee that the radius of curvature of the cable 14 does not drop below a lower limit. The cable 14 for example comprises a core formed of electrical and/or optical conductors that allow energy and information to be transmitted between sonar equipment situated onboard the ship 10 and the antennas 12 and 13. The core of the cable 14 is generally covered by strands of metal wires that provide the cable 14 with its mechanical strength, notably its tensile strength. Below the lower limit of curvature, there is a risk of permanent deformations or breaks of parts of the cable 14.

Figure 2:
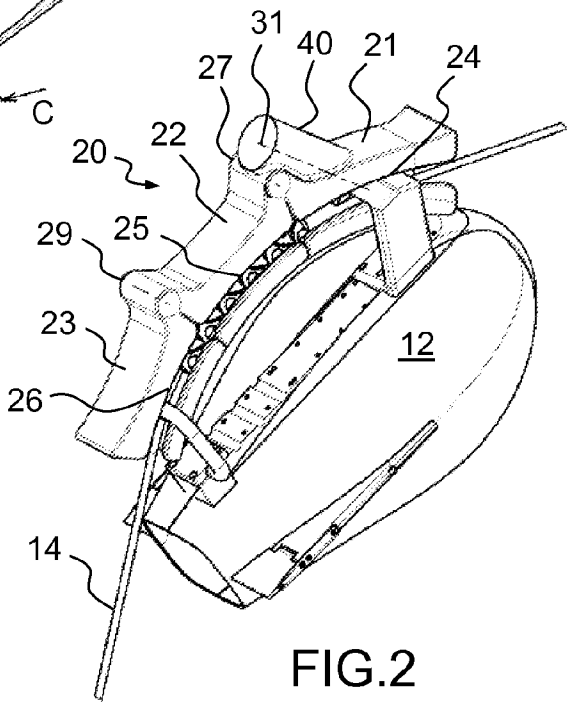
FIGS. 2, 3 and 4 depict an example of a fairlead used in a towing device intended to be fitted to the ship for towing the sonar.
Figure 3:
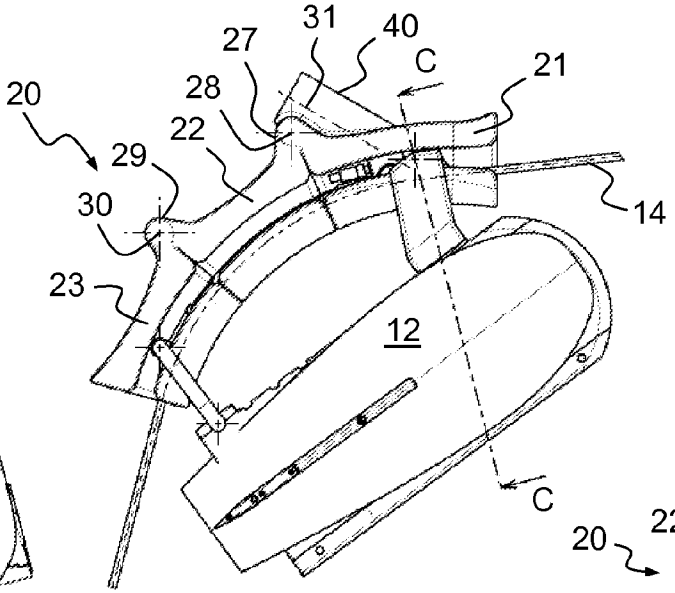
Figure 4:
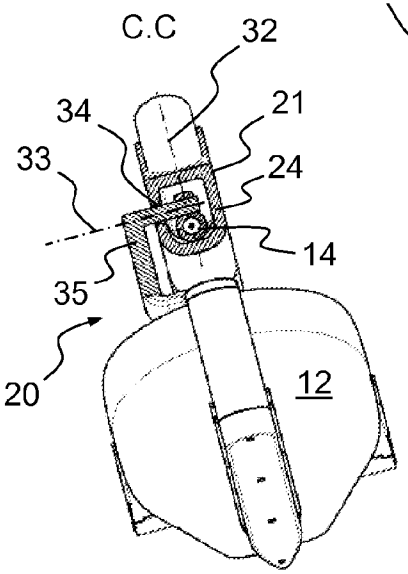

FIGS. 2, 3 and 4 depict the fairlead 20 when a fish 12, attached to the cable 14, passes through it. FIG. 2 is a perspective view, FIG. 3 is a view in a plane in which the cable 14 bends and FIG. 4 is a view in cross section in a plane perpendicular to the cable 14.

According to the invention, the fairlead 20 comprises at least two sectors articulated to one another. In the example depicted, the fairlead 20 comprises three sectors 21, 22 and 23. Of course a higher number of sectors is possible without departing from the scope of the invention.

Each of the sectors comprises a groove 24 for sector 21, 25 for sector 22 and 26 for sector 23. These grooves guide the cable 14 along the entire length of the fairlead 20. They are more or less in the continuation of one another. Each of the sectors 21, 22 and 23 runs substantially in the direction of the cable 14 while at the same time allowing the cable 14 to bend. Each of the sectors 21, 22 and 23 is dimensioned in such a way as to limit the maximum curvature of the cable 14.

In addition, the fairlead 20 comprises an articulation 27 connecting the sectors 21 and 22. The articulation 27 has just one degree of freedom to rotate about an axis 28 substantially perpendicular to a direction in which the cable 14 runs substantially through the fairlead at the articulation 27. The articulation having a degree of freedom to rotate is also referred to as a pivot connection.

Likewise, the fairlead 20 comprises an articulation 29 connecting the sectors 22 and 23. The articulation 29 has just one degree of freedom to rotate about an axis 30 substantially perpendicular to a direction in which the cable 14 runs substantially through the fairlead at the articulation 29. The axes 28 and 30 of the two articulations 27 and 29 remain parallel to one another as the sectors 21, 22 and 23 rotate relative to one another. The axes 28 and 30 are perpendicular to the plane of FIG. 3.

For each of the articulations 27 and 29, the fairlead 20 comprises means of limiting the angular travel thereof. More specifically, the sectors 21, 22 and 23 can come into abutment against one another in order to limit the angular travel of each of the articulations 27 and 29. This butting-together of the sectors 21, 22 and 23 also limits the radius of curvature of the cable 14. In other words, the radius of curvature of the cable 14 is limited both by the shape and dimensions of the sectors considered individually and by the maximum ability of the sectors to move relative to one another.

The various sectors 21, 22 and 23 allow the cable 14 to change direction in the plane of FIG. 3. For example, each of the sectors 21, 22 and 23 can be defined in such a way that they allow the cable 14 to change direction by a maximum of 30°. For three sectors a maximum change in direction of 90° may therefore be obtained when the sectors 21, 22 and 23 are in abutment against one another. This change is realized in the plane of FIG. 3. The fairlead 20 makes it possible to limit the radius of curvature of the cable 14 during this change in direction.

It is possible to fix the sector 21 onto a supporting structure secured to the aft platform 19. When this is so, the fairlead 20 will be arranged in such a way that the articulations 27 and 29 are horizontal. This layout allows the cable 14 to be pivoted from a substantially horizontal direction with respect to the ship 10 into a substantially vertical direction. The horizontal direction is, for example, the direction adopted by the cable 14 upstream of the fairlead 20, between the drum 18 and the fairlead 20. The vertical direction is, for example, that adopted by the cable 14 downstream of the fairlead 20 as the cable 14 enters the water. A 90° change in direction is obtained when the ship 10 is stationary or when a towed body is being immersed. The cable 14 therefore drops vertically down into the water. The sectors 21, 22 and 23 are then all in abutment against one another. As the ship 10 picks up speed, the cable 14 becomes inclined to reduce the inclination of the change in direction. The sectors 21, 22 and 23 are then no longer in abutment against one another and pivot relative to one another about the articulations 27 and 29.

This fixed arrangement of the sector 21 with respect to the ship 10 does, however, present a disadvantage when the ship changes heading. In a horizontal plane, the cable 14 has then to change direction with respect to the ship's heading. This change in direction may, for example, be achieved by means of a flared trumpet shape of the last sector of the fairlead 20 which, in the example depicted, is the sector 23. This flared trumpet shape does not allow significant changes in direction. Advantageously, the first sector 21 is articulated with respect to the ship 10 so as to allow a greater amplitude of change in direction of the cable 14 when the ship 10 changes heading. Such an articulation also provides better guidance of the cable 14 over the entire length of the fairlead 20 and notably in the final sector 23.

More specifically, the fairlead 20 comprises a supporting structure and an articulation 40 with a degree of freedom to rotate about an axis 31, the articulation 40 connecting the sector 21 and the supporting structure. The supporting structure may be fixed to the ship 10, for example on the aft platform 19 or on a reeling system allowing correct stowage of the cable 14 on the drum 18. When the supporting structure is fixed to the reeling system, it is the entire fairlead 20 that effects translational movements parallel to the axis of the drum 18 in order to stow the cable 14 correctly on the drum 18. The axis 31 is contained in a plane 32 perpendicular to the axis 28 of the articulation 27. This is the plane of FIG. 3 which is also shown in FIG. 4. The plane 32 can be inclined with respect to a vertical plane of the ship 10, notably when the ship 10 changes its heading. The inclination of the plane 32 is achieved when the articulation 40 pivots. When the cable 14 passes through the fairlead 20, it is always contained in the plane 32 and the loads experienced by the cable 14 upstream and downstream of the fairlead 20 are always contained in the plane 32. The fairlead 20 pivots about the articulation 40 according to the direction of the loads applied to the cable 14.

The axis 31 may be parallel to the direction followed by the cable 14 between the fairlead 20 and the winch 16. This layout of the articulation 40 nonetheless leads to lateral travel of the cable 14 in the sector 21. To alleviate this problem, the axis 31 advantageously intersects the groove 24 at a point 41 at which the cable 14 is designed to come into contact with the groove 24 on the winch 16 side. This orientation of the axis 31 allows a marked improvement in the control over the actual point at which the cable 14 and the sector 21 come into mutual contact. It is then easier to correctly manage the position of the cable 14 between the fairlead 20 and the winch 16 and thus avoid problems of poor winding of turns of the cable 14 onto the drum 18. It will be noted that when the supporting structure is fixed with respect to the ship 10, there can be a small offset between the point 41, defined during the design of the fairlead 20, and the actual point at which the cable 14 comes into contact with the sector 21. This offset is caused, for example, by the winding of several turns of cable 14 onto the drum 18. However, this offset remains small in relation to the possible lateral travel of the cable 14 when the axis 31 is parallel to the direction of the cable 14. By contrast, when the supporting structure is secured to a reeling system, the actual point of contact remains coincident with the point 41.

Along the entire length of the three sectors 21, 22 and 23, the corresponding grooves 24, 25 and 26 have substantially constant cross sections. The shape of the cross section of one of these grooves can be made out in FIG. 4. The groove 24 has a cross section in the shape of a letter C with the opening at the side, i.e. open along an axis 33 substantially perpendicular to the plane 32. The opening 34 of the groove 24 may allow the cable 14 to be inserted into the fairlead 20. The opening 34 above all allows a fixing 35 for the fish 12 to pass along the fairlead 20. The fish 12 can thus be raised back onboard the ship 10 and detached from the cable between the fairlead 20 and the winch 16. That being the case, the position of the fish 12 with respect to the ship 10 can be perfectly known and controlled. The only parameter capable of influencing the position of the fish 12 is the control of the winch 16. It thus becomes possible to dispense with an articulated arm for maneuvering the fish onboard the ship 10, notably for attaching it to and detaching it from the cable 14.

Figure 5:
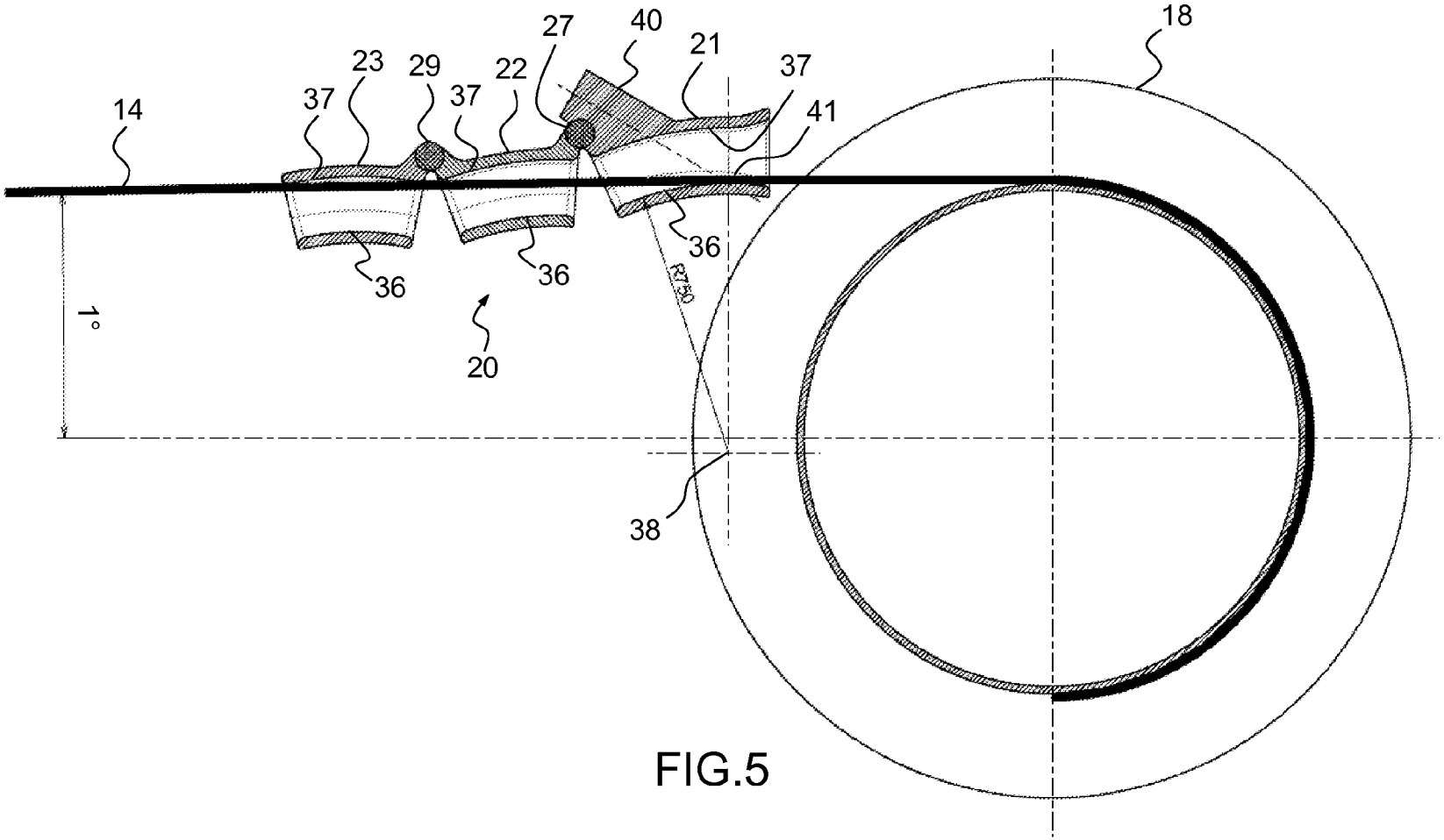
FIGS. 5, 6 and 7 depict various alternative forms of fairlead in cross section in a plane containing a cable.
Figure 6:
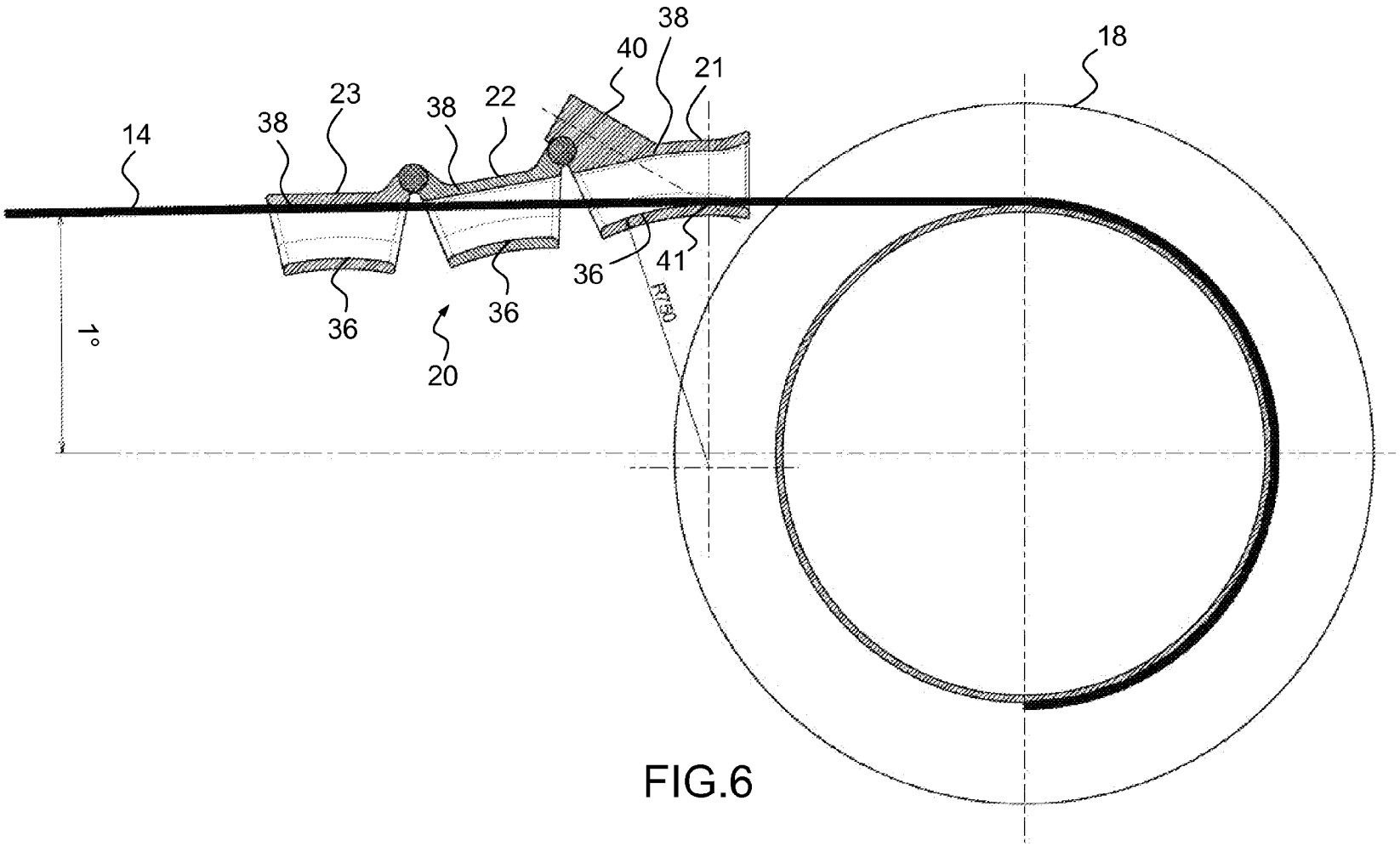
Figure 7:
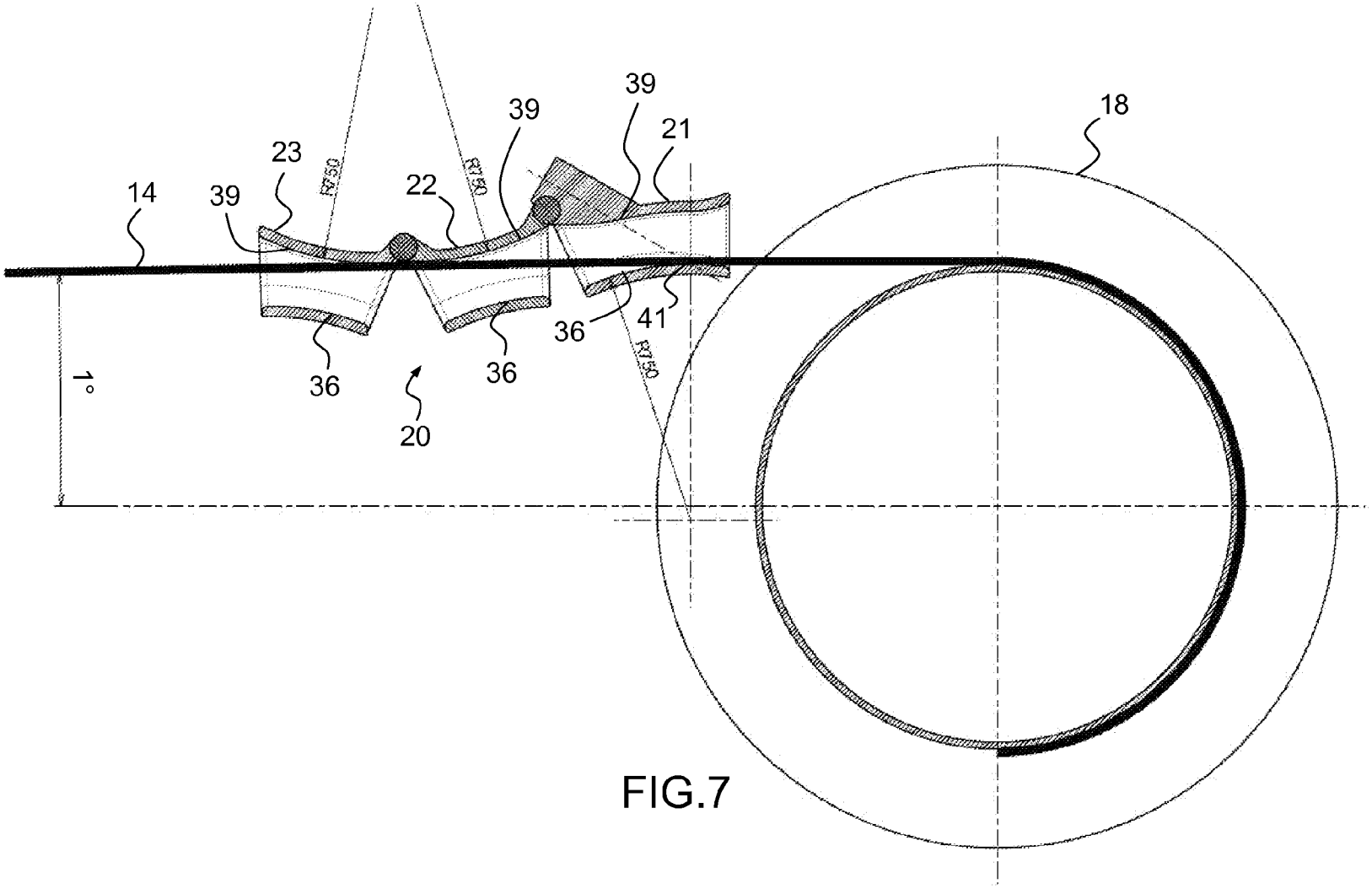

FIGS. 5, 6 and 7 depict a number of alternative forms of fairlead in cross section on the plane 32. These figures are depicted in cross section in a plane passing through the axis of the cable 14, considering the boat to be following a substantially straight heading. In these various figures, the cable 14 is substantially horizontal upstream of the fairlead 20, between the drum 18 and the fairlead 20. Downstream of the fairlead the cable inclines by 1° downward. This value has been chosen so that the cable 14 will definitely bear against one of the faces of the groove of the first sector 21. Of course, the fairleads depicted in these figures can be used for other sizes of angle.

In FIG. 5, the grooves of the various sectors 21, 22 and 23 have constant cross sections over most of the sector concerned, with the exception of the sector entry and exit zones in which the groove may be chamfered in order to avoid any risk of damaging the cable 14. In the example depicted, the groove of the sector 21 has two bearing zones 36 and 37 against which the cable 14 can bear. When the cable 14 is inclined downward, as depicted in FIG. 5, the cable 14 bears on the lower zone 36 and when the cable 14 is inclined upward, the cable bears on the upper zone 37. The two zones 36 and 37 have a curvature in both instances centered on a point 38 situated underneath the fairlead 20. The radius of curvature of the zone 36 is defined by the minimum radius of curvature below which the cable 14 must not be bent. The other sectors 22 and 23 have zones of contact with the cable 14 which are identical and therefore identified in the same way: 36 and 37. This alternative form is of benefit when the inclination of the cable 14 is almost definitely oriented downward downstream of the fairlead, which it usually is during a towing operation.

FIG. 6 again shows for the three sectors 21, 22 and 23 the lower bearing zones 36 that ensure a minimum radius of curvature for the cable 14 as this cable inclines downward. By contrast, in this alternative form, each sector comprises an upper bearing zone 38 that is substantially planar, allowing better distribution of the contact between the cable and the sectors as the cable is raised downstream of the fairlead 20 until it comes into contact with one or more bearing surfaces 38. There is thus less of a risk of wear in the zones where the cable 14 rubs against the groove.

FIG. 7 again shows, still for the three sectors 21, 22 and 23, the lower bearing zones 36 that ensure a minimum radius of curvature for the cable 14 as it inclines downward. In this alternative form, each sector comprises an upper bearing zone 39 the curvature of which is the reverse of that of the lower zone 36 so as to allow the cable 14 to come up downstream of the fairlead during repeated use. It is beneficial in this alternative form to provide a possibility for the three sectors to come into abutment with one another in order to prevent the cable from exceeding a limiting curvature in the upward direction.

Figure 8:
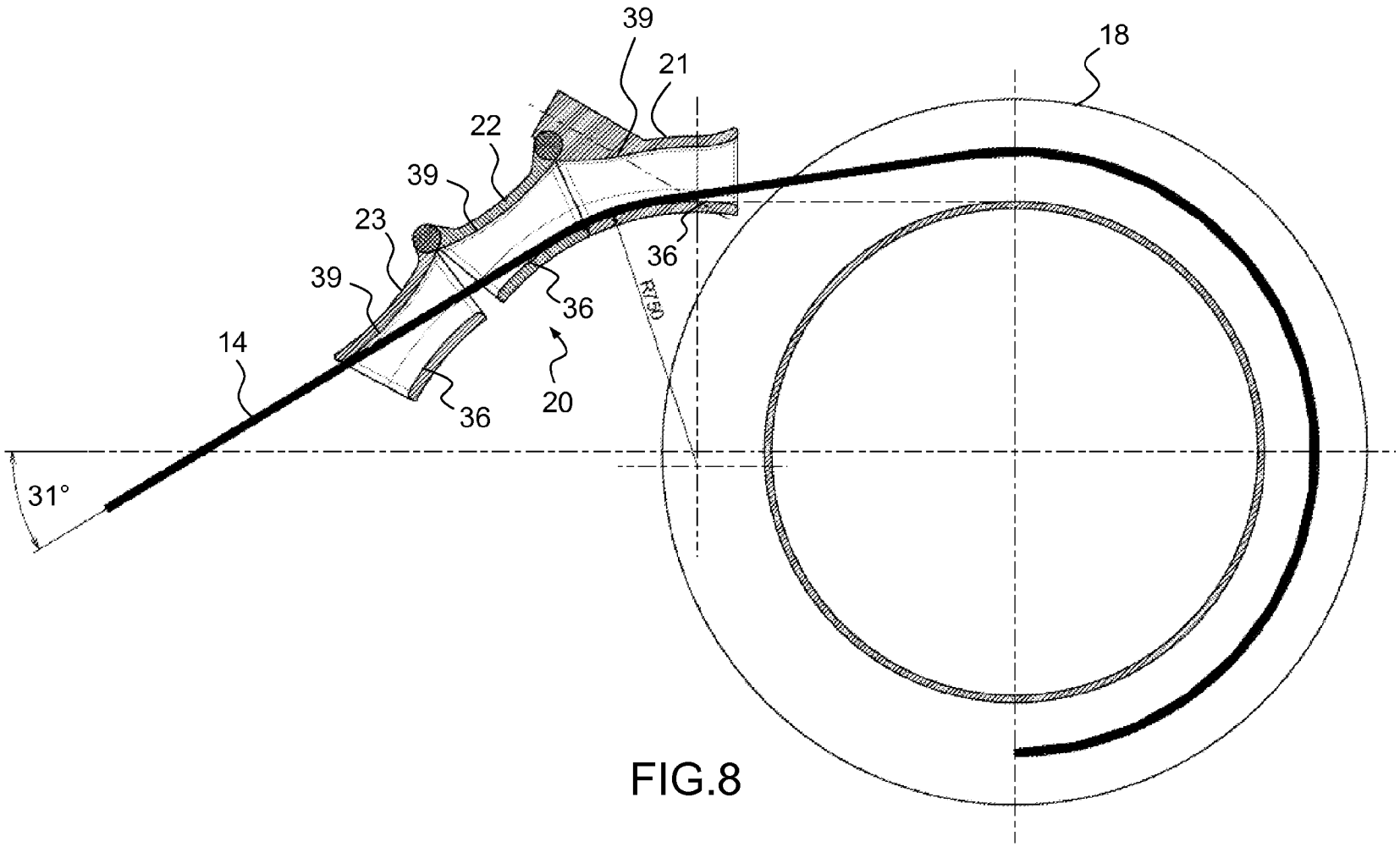
FIG. 8 depicts the fairlead of FIG. 7 in another position.

FIG. 8 depicts the fairlead of FIG. 7 in a position in which the cable 14 is inclined by 31° downward downstream of the fairlead 20. In this figure, the cable 14 is wound onto the drum 18 in successive layers, and in one of the final layers, the inclination of the cable between the drum 18 and the fairlead 20 increases by comparison with the first layer. The sector 21 is dimensioned to allow the cable 14 to enter whatever the layer on the drum 18.

The invention claimed is:

1. A towing device, intended to be fitted to the deck of a ship, comprising: a winch, a cable and a fairlead, the cable running through the fairlead under the action of the winch, wherein the fairlead comprises at least a first and a second sector, the sectors allowing the cable to be guided in a groove made in each of the sectors, a first articulation with a degree of freedom to rotate about an axis, the articulation connecting the two sectors, the axis being substantially perpendicular to a direction in which the cable runs substantially through the fairlead at the articulation, and limiting means that limit the angular travel of the articulation, and wherein the sectors and the limiting means are dimensioned so as to prevent the cable from exceeding a lower limit of radius of curvature, wherein the fairlead is fixed relative to the winch, and wherein each of the grooves has a lower bearing zone and an upper bearing zone, against which zones the cable can bear, and wherein the lower bearing zone has a curvature centered on a point situated underneath the fairlead.

2. The device as claimed in claim 1, further comprising a third sector and a second articulation having a degree of freedom to rotate about an axis, the second articulation connecting the second to the third sector, the axis of the second articulation being parallel to the axis of the first articulation.

3. The device as claimed in claim 2, wherein the second articulation has only one degree of freedom in rotation.

4. The device as claimed in claim 1, wherein the fairlead comprises a supporting structure and a third articulation having a degree of freedom to rotate about an axis, the third articulation connecting the first sector and the supporting structure, the axis of the third articulation being comprised in a plane perpendicular to the axis of the first articulation.

5. The device as claimed in claim 4, wherein the axis of the third articulation intersects the groove of the first sector at a point at which the cable is intended to come into contact with the groove of the first sector on the winch side.

6. The device as claimed in claim 1, wherein the grooves of the various sectors have substantially constant cross sections in the shape of the letter C with the opening to the side.

7. The device as claimed in claim 1, wherein the upper bearing zone is substantially planar.

8. The device as claimed in claim 1, wherein the upper bearing zone has a curvature that is the reverse of that of the lower bearing zone.

9. The device as claimed in claim 1, wherein the first articulation has only one degree of freedom in rotation.

* * * * *